US006158652A

United States Patent [19]

Ruiz et al.

[11] Patent Number: 6,158,652

[45] Date of Patent: Dec. 12, 2000

[54] CONTAINER WITH WALL LOCKING FEATURE

[75] Inventors: David Ruiz, Madera; Philip Weideman, Fresno, both of Calif.

[73] Assignee: Georgia-Pacific Corporation, Atlanta, Ga.

[21] Appl. No.: 09/373,557

[22] Filed: Aug. 13, 1999

[51] Int. Cl.[7] ..... B65D 5/22

[52] U.S. Cl. ..... 229/178; 229/177; 229/194; 229/915; 229/919; 493/167

[58] Field of Search ..... 229/177, 178, 229/194, 915, 919; 493/167–174

[56] References Cited

U.S. PATENT DOCUMENTS

| | | | |
|---|---|---|---|
| 516,124 | 3/1894 | Sherman . | |
| 1,912,952 | 6/1933 | Scruby . | |
| 1,973,209 | 9/1934 | Hooker . | |
| 1,982,962 | 12/1934 | McAleer . | |
| 2,072,256 | 3/1937 | Greve . | |
| 2,196,502 | 4/1940 | Kells . | |
| 2,439,959 | 4/1948 | Anderson, Jr. | 229/194 |
| 2,570,804 | 10/1951 | Hazenfield . | |
| 2,741,415 | 4/1956 | Meitzen . | |
| 3,973,723 | 8/1976 | Owens | 229/178 |
| 4,245,773 | 1/1981 | Stollberg | 229/915 |
| 4,305,544 | 12/1981 | Noonan . | |
| 4,353,496 | 10/1982 | Nelson, Jr. et al. | 229/915 |
| 5,125,567 | 6/1992 | McClure . | |
| 5,295,631 | 3/1994 | McClure . | |
| 5,458,283 | 10/1995 | Southwell et al. . | |
| 5,649,663 | 7/1997 | Pestow, Jr. | 229/915 |

FOREIGN PATENT DOCUMENTS

| | | | |
|---|---|---|---|
| 76284 | 8/1961 | France | 229/178 |

*Primary Examiner*—Gary E. Elkins
*Attorney, Agent, or Firm*—Banner & Witcoff, Ltd.

[57] ABSTRACT

A container for holding produce having a floor, four sidewalls and a cover. Two of the four sidewalls are multi-layered with a core including a plurality of interlocking panels. The interlocked panels are lockingly connected in coplanar pairs through a set of complementary locking contours. Pairs of interlocked panels overlap in a back-to-back relationship to form a "dual-lock" arrangement. The coplanar, dual-lock arrangement allows the sidewalls and floor to be tightly interlocked thereby enabling the container to resist higher loads without buckling. The cover panels protect the enclosed produce while letting in air for ventilation through a plurality of ventilation holes.

27 Claims, 5 Drawing Sheets

CONTAINER WITH WALL LOCKING FEATURE

BACKGROUND OF THE INVENTION

The present invention relates to the field of storage containers. More particularly, the present invention relates to storage containers of the fiberboard type that are frequently used for the storage and transport of produce.

In the grocery business, the profits generated depend upon a large volume of products flowing through to produce earnings. Because of the large volume of shipments, improvements in packaging that protects products from damage and loss are in great demand. The large amount of shipments occurring also provide a strong incentive for decreasing the cost of the packaging, even to the extent of a few pennies per container.

One effective technique of minimizing the cost of packaging is to reduce the amount of material and labor used in constructing the container. A balance must be struck, however, because using too little material will adversely affect the strength of the container. This is a particularly difficult proposition for the shipment of raw produce. Raw produce tends to be delicate, but at the same time, heavy and water-laden. The handling of produce containers is also a problem because they are frequently stacked and are therefore subject to stacking loads from the weight of the containers above them. The stacking loads may crush the containers and damage the delicate produce contained therein.

Solutions to this problem have been attempted in the prior art through the use of containers with reinforced walls. The walls are reinforced through the use of multiple layers of fiberboard in some type of overlapping arrangement. In one arrangement, the container has a floor, a first and second set of sidewalls and a lid. Each sidewall of the first set of sidewalls is further equipped with a pair of minor flap emanating from the lateral edges of the first sidewall. After the first sidewalls are folded upwards, the pair of minor flaps are folded inwards until are adjacent to the pair of minor flaps of the opposing first sidewall. The second set of sidewalls are then folded upwards until they are flush with the minor flaps. The second set of sidewalls are then folded downwards to effectively "sandwich" the minor flaps within the second set of sidewalls. One drawback of this arrangement is that the floor can still sag or collapse.

Some prior art containers include minor flaps that are long enough to allow the free edges of the flaps to overlap. However, this arrangement has drawbacks as well. For example, the overlap between flaps requires the use of extra material which raises costs. Additionally, it also reduces the contact area between the second pair of sidewalls and the flaps, generally making the structure weaker. Accordingly, a more reliable container was needed.

SUMMARY OF THE INVENTION

In view of the foregoing, it is a principal object of the present invention to provide a cost effective container without sacrificing strength.

It is a further object of the invention to provide a reinforced container using multiple layers of material that does not buckle or separate under loading even without the use of a fastener or glue.

It is still another object of this invention to provide a container with multilayered walls without the need for bulky overlapping sidewall layers that raise costs through the use of excess material and inhibit the structural soundness of the container.

These and other objects are achieved in accordance with the present invention by a container including a floor, and a first and second pair of sidewalls extending upwards from the floor. The second pair of sidewalls each include an inner panel facing the inside of the container and forming an inner surface, an outer panel facing the outside of the container and forming an outer surface and a first and second interlocked wall panels. The first and second interlocked wall panels are lockingly engaged with each other in a coplanar arrangement. The pair of interlocked wall panels lie between the outer panel and the inner panel of its respective sidewalls.

In another aspect of the invention, the objects are achieved by a container comprising a floor, a first pair of opposing sidewalls extending upwards from the floor and a second pair of sidewalls extending upwards from the floor. Each of the second pair of sidewalls is multi-layered and includes an inner panel forming an inner surface, an outer panel forming an outer surface and a first, second, third, and fourth interlocked wall panels. The first and second interlocked wall panels are lockingly engaged with each other, as are the third and fourth interlocked wall panels. The first and second interlocked wall panels are disposed in back-to-back, flush contact with the third and fourth interlocked wall panels forming a dual-lock arrangement. All four interlocked wall panels are, in turn, disposed between their respective inner and outer panels.

In still another aspect of the invention is a blank for forming the container which includes a floor panel, a first, second, third and fourth opposing sidewall panels and a first, second, third and fourth opposing wall panels. The first and second opposing sidewall panels each connect to the floor panel along a respective first and second foldlines and become the first pair of sidewalls in the finished container. The third and fourth opposing sidewall panels each connect to the floor panel along respective third and fourth foldlines and become part of the second pair of sidewalls in the finished container. The third and fourth sidewall panels each include a first segment panel connected along a foldline to the floor panel and a second panel segment coupled to the first panel segment. The first and second opposing wall panels each have a proximal end coupled to the first opposing sidewall panel and a distal end which includes a first planar locking contour. The third and fourth opposing wall panels each have a proximal end coupled to the second opposing sidewall and a distal end including a second planar locking contour. The second planar locking contour is complementary to the first planar locking contour and allows the adjacent wall panels to be lockingly connected when constructing the container.

In a fourth aspect of the invention is another blank for forming a container, this blank includes a floor panel, a first, second, third and fourth opposing sidewall panels and a first through eighth opposing wall panels. The first and second opposing sidewall panels are each connected to the floor panel along a first and second foldlines, respectively, and become the first pair of opposing sidewalls in the erected container. For the third and fourth opposing sidewall panels, each of the panels is connected to the floor panel along a third and a fourth foldline, respectively. The third and fourth opposing sidewall panels each have a first panel segment connected along a foldline to the floor panel, and a second panel segment coupled to the first panel segment. The first panel segment becomes the outer panel of the completed container, while the second panel segment becomes the inner panel of the completed container. The first and second opposing wall panels each have a proximal end coupled to the first opposing sidewall panel and a distal end which includes a first locking contour. The third and fourth opposing wall panels also have a proximal end coupled to the second opposing sidewall and a distal end including a second locking contour. This second locking contour is complementary in shape to the first locking contour and allows their respective panels to be lockingly engaged when constructing the container. The fifth wall panel is coupled to the first wall panel and the sixth wall panel is coupled to the second wall panel. The fifth and sixth wall panels each have a distal end with a third locking contour. The seventh wall panel is coupled to the third wall panel and the eighth wall panel is coupled to the fourth wall panel. The seventh and eight wall panels each have a distal end which includes a fourth locking contour. The fourth locking contour is complementary in shape to the third locking contour and the locking contours allow their respective panels to be lockingly engaged to form the dual-lock arrangement of the completed container.

In a fifth aspect of the invention, a method of constructing the container comprising several steps. The first step is providing a blank having a floor panel, a first, second, third, and fourth opposing sidewall panels and a first, second, third and fourth wall panels. The first and second opposing sidewall panels are folded upwardly along a pair of foldlines connecting the first and second opposing sidewall panels to the floor panel. This completes the first pair of opposing sidewalls. The first, second, third, and fourth wall panels are folded inwardly along foldlines connecting them to the first pair of opposing sidewalls. The first and third wall panels are lockingly engaged in a coplanar arrangement to form a first pair of interlocked wall panels. The second and fourth wall panels are also lockingly engaged in a coplanar arrangement to form a second pair of interlocked wall panels. The third and fourth sidewall panels are folded upwardly along a pair of foldlines connecting them to the floor panel to form a pair of outer panels. The same panels are then folded downwards and inwards until flush with their respective interlocked wall panels to form a pair of inner panels. This step completes the second pair of opposing sidewalls.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 6:
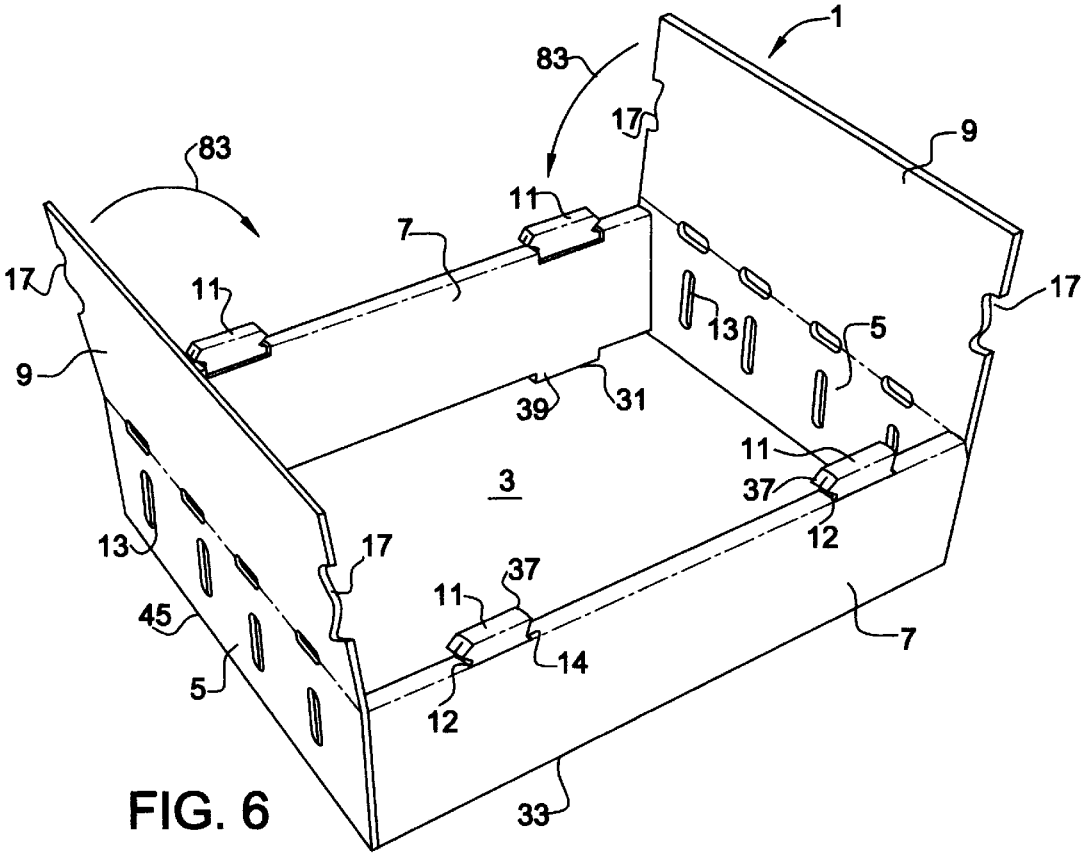
FIG. 6 is a perspective view of the blank in FIG. 1 formed into the completed container with the lid flaps in an open position.
Figure 7:
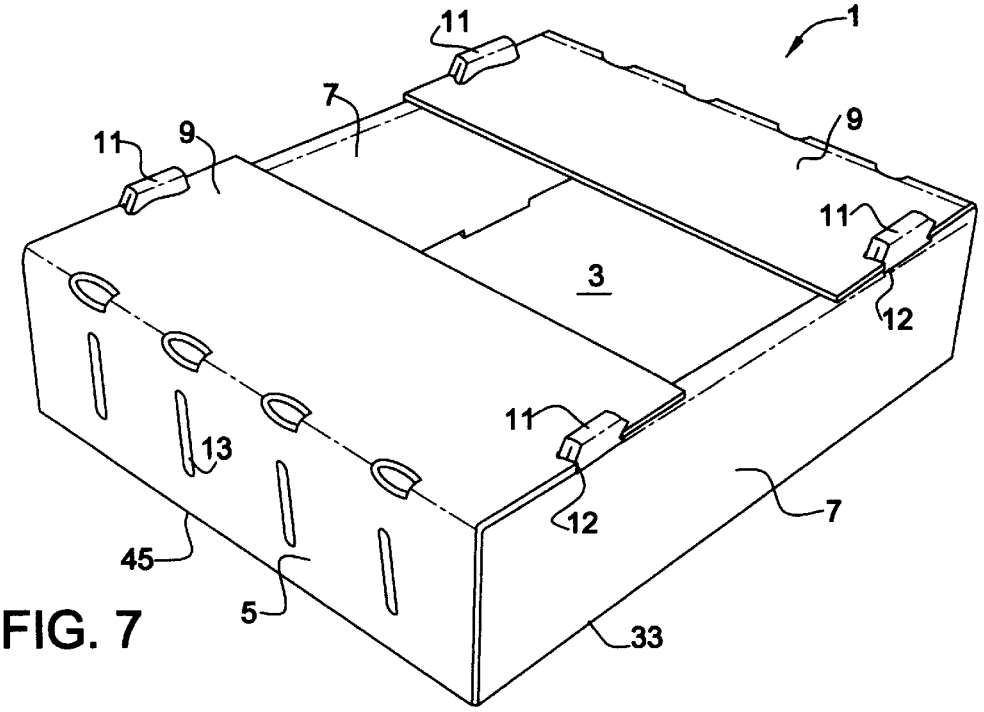
FIG. 7 is a perspective view of the container of FIG. 6 with the lid flaps in a closed position.

FIGS. 6 and 7 show a preferred embodiment of the fully constructed box or container 1. In sum, container 1 includes a generally horizontal floor 3, a first pair of opposing vertical sidewalls 5, a second pair of opposing vertical sidewalls 7, and a pair of covers or lids 9. The lids 9 are shown in a closed position in FIG. 7 and in an open position in FIG. 6. All of the aforementioned parts are interconnected to provide a structurally sound container that resists buckling when floor 3 is heavily loaded. The floor 3 supports any contents within the container 1, such as produce. The floor 3 is attached to the first pair of opposing sidewalls 5 through a foldline 45. The floor 3 is also connected to the second pair of opposing sidewalls through a foldline 33. The first and second pairs of sidewalls 5 and 7 are at right angles to each other.

For reference purposes, the first pair of sidewalls 5 and panels extending in that same direction will be referred to as being lateral or laterally oriented. Similarly, the second pair of sidewalls 7 and panels extending in that same direction will be referred to as being longitudinal or longitudinally oriented. These terms are used herein to aid in the description of the invention and should not be construed as limiting the scope of the claims.

Figure 1:
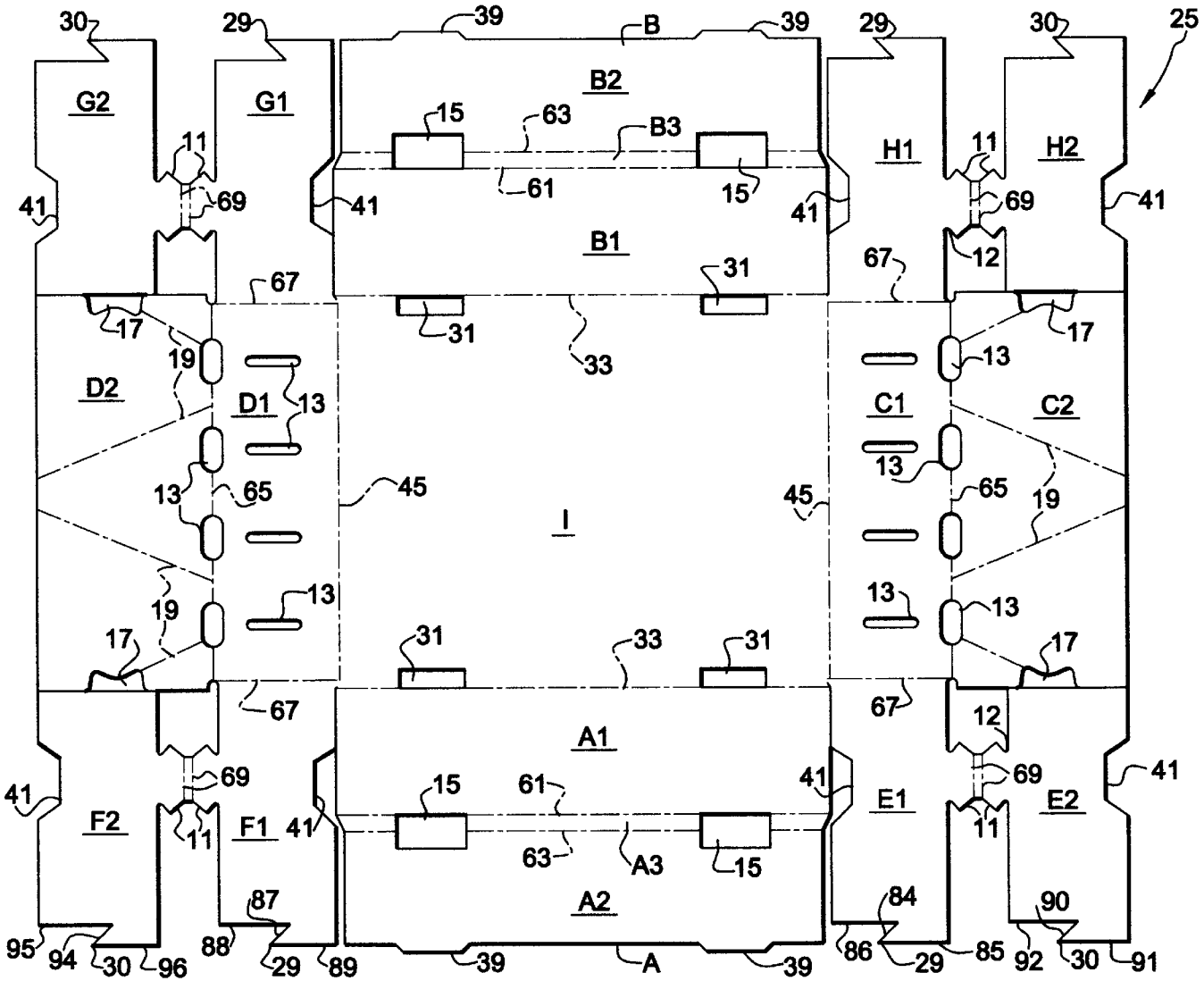
FIG. 1 is a plan view of the scored and cut blank for constructing the dual-lock container.

A blank 25 used for making the container 1 is shown in FIG. 1. Blank 25 is cut and scored into several panels that may be erected into container 1. Blank 25 preferably includes a rectangular floor panel I that is the floor 3 of the container 1. Opposing longitudinal panels A and B extend longitudinally and help form the longitudinal sidewalls 7. Each opposing longitudinal panel A and B helping to form the longitudinal sidewalls 7 includes an inner segment forming an outer wall panel A1 and B1, an outer segment forming an inner wall panel A2 and B2, and a spacer segment A3 and B3 joining the inner and outer segments together. The spacer segments A3 and B3 space the inner and outer segments apart by a distance necessary to accommodate a locking panel arrangement as described later herein.

The blank 25 is scored at the foldline 33 to enable the outer wall panels A1 and B1 to pivot relative to floor panel I. The blank 25 is also scored between spacer segments A3 and B3 and the outer wall panels A1 and B1 at foldline 61 and between spacer segments A3 and B3 and the inner wall panels A2 and B2 at foldline 63.

The blank 25 also includes opposing lateral sidewall panels C1 and D1 that are hinged to the floor panel I at foldline 45. The lateral sidewall panels C1 and D1 are the opposing lateral sidewalls 5 of container 1. Cover panels C2 and D2 are the lids 9 and are coupled to the lateral sidewall panels C1 and D1 at foldline 65 to enable the cover panels C2 and D2 to move between their open and closed positions as shown in FIGS. 6 and 7, respectively.

On one side of the blank 25, interlocking minor panels E1 and H1 are pivotally coupled to opposite ends of lateral sidewall panel C1 at foldline 67. An interlocking extension panel E2 and H2 is pivotally joined to each interlocking minor panel E1 and H1. In a preferred arrangement, the interlocking extension panels E2 and H2 are coupled for pivotal movement with respect to its respective interlocking minor panel E1 and H1 via a locking flange arrangement that includes similarly shaped locking flanges 11 with one or more foldlines 69 therebetween.

Similarly, interlocking minor panels F1 and G1 are pivotally coupled to opposite ends of lateral sidewall panel D1 at foldline 67. Further, each interlocking extension panel F2 and G2 is pivotally joined to each interlocking minor panel F1 and G1. As with the other side of the blank 25, the interlocking extension panels F2 and G2 are coupled for pivotal movement with respect to its respective interlocking minor panel F1 and G1 via a locking flange arrangement that includes similarly shaped locking flanges 11 with one or more foldlines 69 therebetween.

The end of each of the interlocking minor panels E1, F1, G1, and H1 that is distal from the lateral sidewalls C1 and D1 has a contour 29 that is shaped to interlock with the distal end of the interlocking minor panel on the same lateral side of the opposite lateral sidewall C1 and D1 to which it is joined. Thus, the end of interlocking minor panel E1 interlocks with the end of interlocking minor panel F1. Similarly, the end of interlocking minor panel G1 interlocks with the end of interlocking minor panel H1.

The end of each of the interlocking extension panels E2, F2, G2, and H2 has a contour 30 that is shaped to interlock with the lateral distal end of the interlocking extension panel extending from the opposite lateral sidewall C1 and D1. Thus, the end of interlocking extension panel E2 interlocks with the end of interlocking extension panel F2, and the end of interlocking extension panel G2 interlocks with the end of interlocking extension panel H2.

Figure 8:
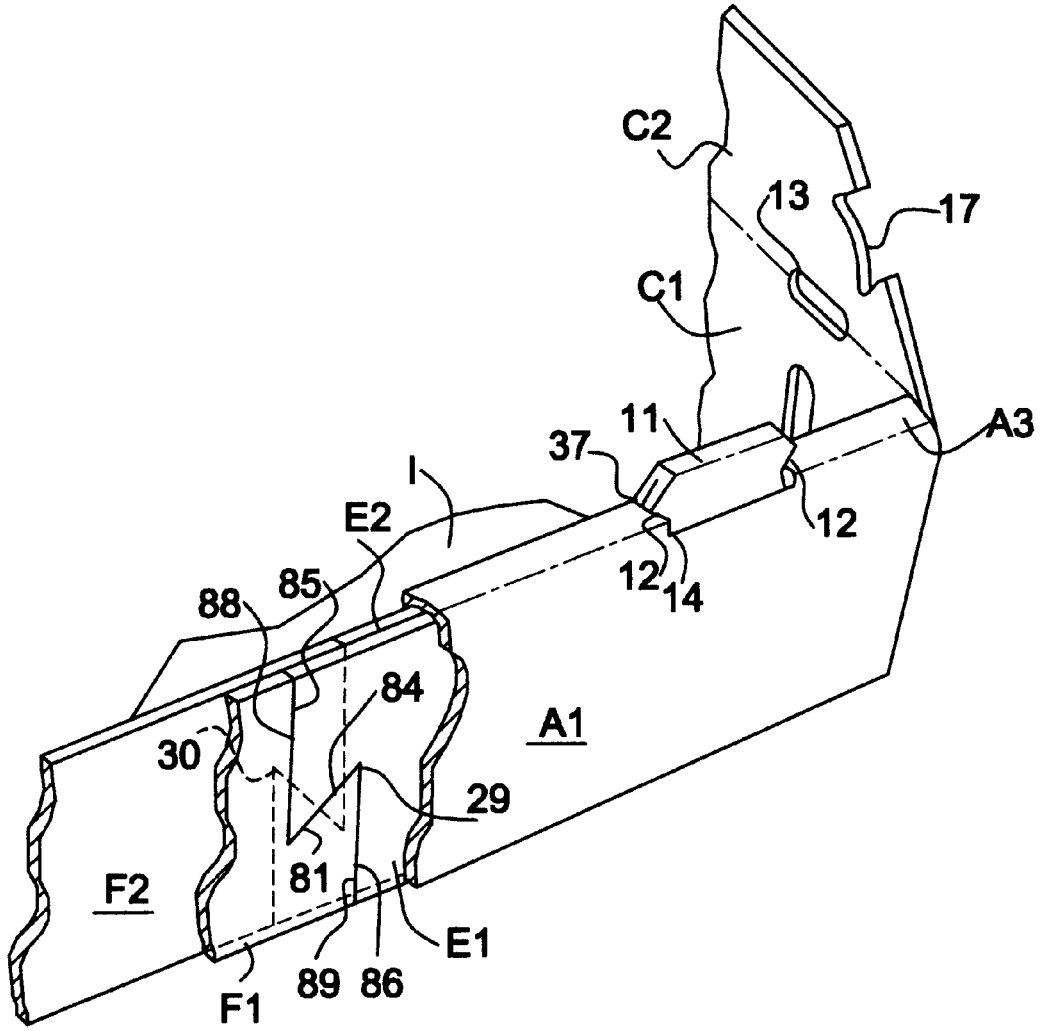
FIG. 8 is a detailed perspective cut-out view of the second pair of opposing sidewalls exhibiting the dual-lock characteristic of overlapping segment pairs.

At least a portion of each of the mating interlocking contours 29 is shaped to be complementary to a portion of the contour 29 of a mating minor panel to allow the minor panels E1 and F1, and G1 and H1 to engage with each other and achieve a coplanar arrangement as shown in FIG. 8. Similarly, at least a portion of the mating interlocking contours 30 is shaped to be complementary to at least a portion of the contour of a mating extension panel to allow the extension panels E2 and F2, and G2 and H2 to engage with each other and achieve a coplanar arrangement. The desired engagement between the contours 29 and 30 resists forces that would tend to separate the panels.

In a preferred embodiment as shown in FIG. 8, interlocking contours 29 and 30 are Z-shaped. Each of the contours 29 and 30 has a diagonal surface, an upper vertical surface, and a lower vertical surface. For example, the end contour 2 9 of minor panel E1 has a diagonal surface 84, an upper vertical surface 85, and a lower vertical surface 86. The end contour 29 of minor panel F1 also has a diagonal surface 87, an upper vertical surface 88, and a lower vertical surface 89. When assembled, the Z-shaped contours 29 interlock, as the projecting tip on minor panel E1 formed by the diagonal surface 84 and an adjacent portion of upper vertical surface 85 fits inside a triangular recess formed in minor panel F1 by the diagonal surface 87 and an adjacent portion of upper vertical surface 88. Simultaneously, the projecting tip on minor panel F1 formed by the diagonal surface 87 and an adjacent portion of lower vertical surface 89 fits inside a triangular recess formed in minor panel E1 by the diagonal surface 84 and an adjacent portion of lower vertical surface 86. The remaining portions of the upper and lower vertical surfaces resist separation of the wall panels as they will abut its respective corresponding surface upon the application of any applied rotational forces and most applied linear forces. Accordingly, this arrangement resists any buckling or collapsing of floor I or walls by preventing rotation and other relative movement between the minor panels E1 and F1 that could cause separation.

End contours 30 of extension panels are also Z-shaped and function similar to those of the minor panels. For example, the end contour 30 of extension panel G1 has a diagonal surface 90, an upper vertical surface 91, and a lower vertical surface 92, and the end contour 30 of extension panel H1 also has a diagonal surface 94, an upper vertical surface 95, and a lower vertical surface 96.

The Z-shape of the contours 29 and 30 is advantageous because permits the interlocking of the panels without the need to increase the overall footprint size of the blank 25. Further, it permits easy assembly as the interfacing diagonal surfaces 84 and 87 have an inherent guiding ability, and the Z-shaped profile does not require tight tolerances to prevent separation. However, other shapes may be used for interlocking contours 29 and 30 such as full dovetails, chevrons, etc. depending upon the available space and the characteristics of the container material. Indeed, numerous interlocking shapes, such as those used in jigsaw puzzles may be used to provide the interlocking feature.

The interlocking portions of the Z-shaped interlocking contours 29 and 30 have the same directional bias when cut into blank 25 and connected. However, when the pairs of interlocked extension panels E2, F2, G2, and H2 are folded over into an overlapping arrangement with interlocked minor panels E1, F1, G1, and H1, the orientation of the locking surfaces of the interlocking contours 30 is the reverse of that of the locking surfaces of interlocking contours 29, as shown in FIG. 8. This arrangement provides additional strength and prevents forces in any one direction from overcoming the grip of interlocking contours 29 and 30 and gives them a "dual-lock" characteristic.

The use of coplanar interlocking contours 29 and 30 as a locking feature avoids overlap when connecting the pairs of interlocked wall panels. An overlap in pairs of interlocked wall panels can cause a bulge that can undesirably change the thickness of the longitudinal sidewalls 7 and increase the possibility that a tongue 39 will be pushed loose at from its respective floor groove 31. Additionally, a bulge in the interlocked wall panels due to an overlap can possibly make assembly more difficult because the inner wall panels A2 and B2 and the outer wall panels A1 and B1 have to be forced into conformity with the bulge.

In general, the floor panel I becomes floor 3 of the assembled container 1. The opposing lateral sidewall panels C1 and D1 become the first pair of sidewalls 5. The opposing longitudinal sidewall panels A and B combine with the interlocking minor panels E1, H1, F1, and G1 and the interlocking extension panels E2, H2, F2, and G2 to form the opposing longitudinal sidewalls 7. Thus, each of the pair of longitudinal sidewalls 7 are preferably formed of four layers an outer wall panel A1 or B1, an inner wall panel A2 or B2, a pair of interlocking minor panels E1 and H1 or F1 and G1 in an interlocked state, and a pair of the interlocking extension panels E2, H2, F2, and G2 in an interlocked state. The pair of opposing cover flaps C2 and D2 are the pair of lids 9.

To help in the formation of the longitudinal walls 5, flange openings 15 are provided that extend across the spacer segments A3 and B3 of the longitudinal sidewall panels A and B to enable the locking flanges 11 to extend through. The flange openings 15 preferably extend into the inner wall panels A2 and B2 to provide adequate clearance between the flange openings 15 and the top of the locking flanges 11. Due to the locking flanges 11 having outward wings or projections 12, the spacer segments A3 and B3 are held underneath the locking projections 12 upon assembly.

To further assist in the formation of the longitudinal walls 5, the inner wall panels A2 and B2 are provided with tongues 39 and the floor panel I is provided with floor grooves 31. Upon assembly, the inner wall panels A2 and B2 are folded downwards and the tongues 39 at the bottom edges of the wall inner panels A2 and B2 are inserted into floor grooves 31. To maximize the interior space of the container 1, the floor grooves 31 are positioned immediately adjacent the foldline 33. To provide the desired clearance for the insertion of floor tongues 39 into floor grooves 31 and create and maintain a friction lock, clearance chamfers 41 are provided in the bottom of the interlocking minor panels E1, F1, G1, and H1 and in the interlocking panel extensions E2, F2, G2, and H2.

Each of the cover panels C2 and D2 includes a pair of notches 17 at its lateral ends. The notches 17 interface and lockingly mate with locking flanges 11 in a press fit arrangement when the cover panels C2 and D2 are moved into their closed position. The cover panels C2 and D2 will lock with and be held underneath the locking flanges 11 when the region in front of and behind the notches 17 are pressed under the locking projections 12. If desired, the cover panels C2 and D2 may be provided with foldlines 19 to assist in the flexibility of the cover panels C2 and D2 for moving the cover panels C2 and D2 between their open and closed positions. The cover panels C2 and D2 serve to close-off all, or a portion, of the container 1 depending upon their desired length. Accordingly, once the container 1 is loaded, its contents may be projected from harm by placing the cover panels C2 and D2 in a closed position.

Figure 2:
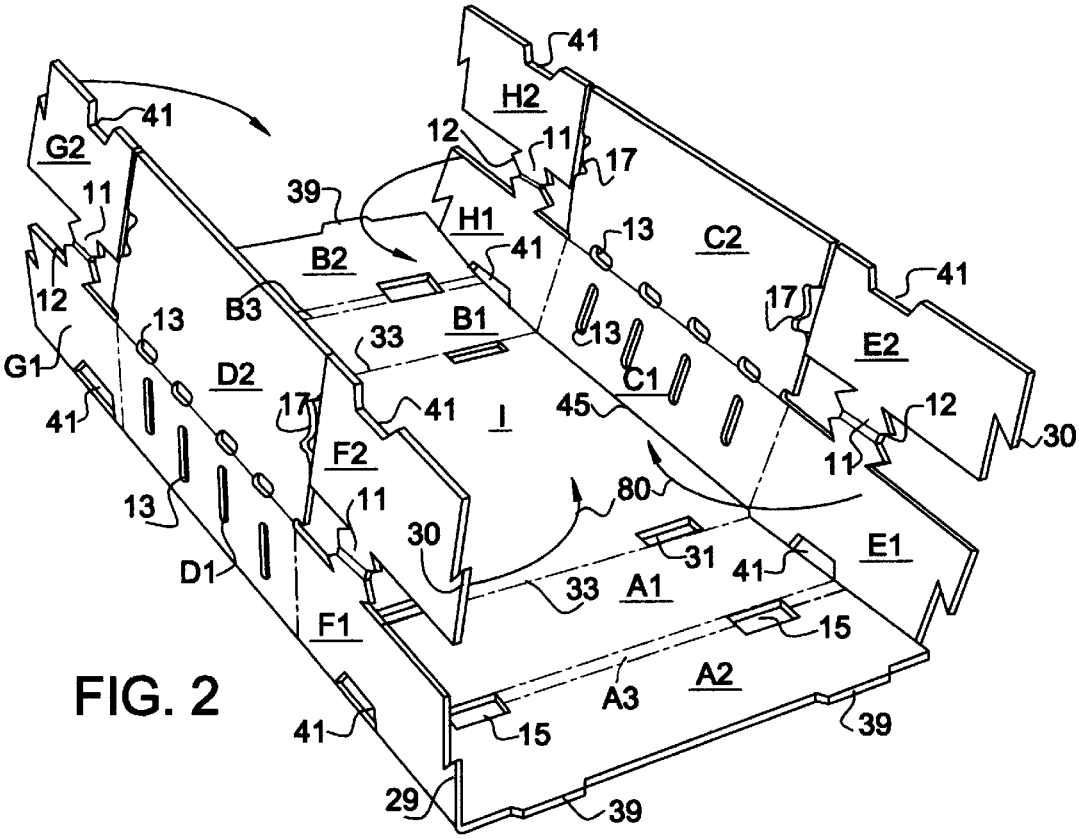
FIG. 2 is a perspective view of the blank in FIG. 1 being folded in a first intermediate state of assembly to form a first pair of opposing sidewalls.

FIGS. 2 through 5 show various intermediate stages of the container during its assembly. In a preferred method for assembling the container 1 from the blank 25, the opposing longitudinal sidewall panels C1 and D1 are folded upwards relative to floor panel I to a vertical position to form the first pair of opposing sidewalls 5. When this is done, the interlocking minor panels E1, F1, G1, and H1, the interlocking extension panels E2, F2, G2, and H2, and the cover panels C2 and D2 will also rotate upwardly with the longitudinal sidewall panels C1 and D1 to remain in the same plane as the longitudinal sidewalls panels C1 and D1. When this has been performed, the blank 25 will be transformed to the container in the state as shown in FIG. 2.

Figure 3:
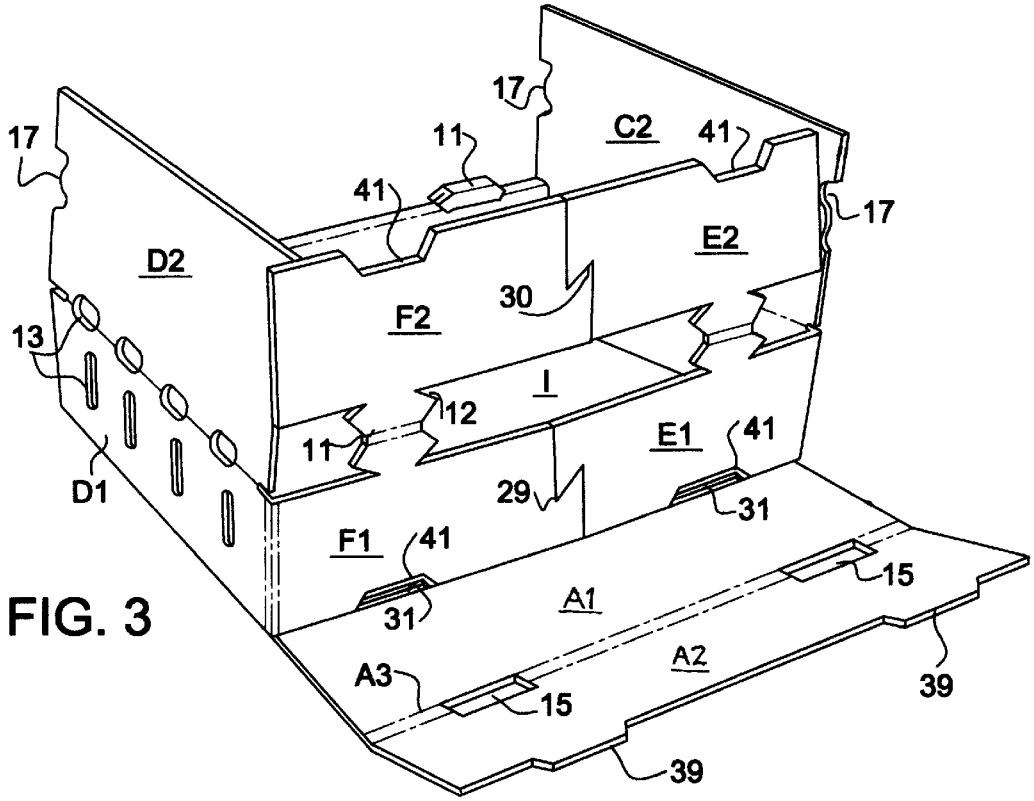
FIG. 3 is a perspective view of the blank in FIG. 1 in a second intermediate state of assembly with segments being interlocked to form segment pairs.
Figure 4:
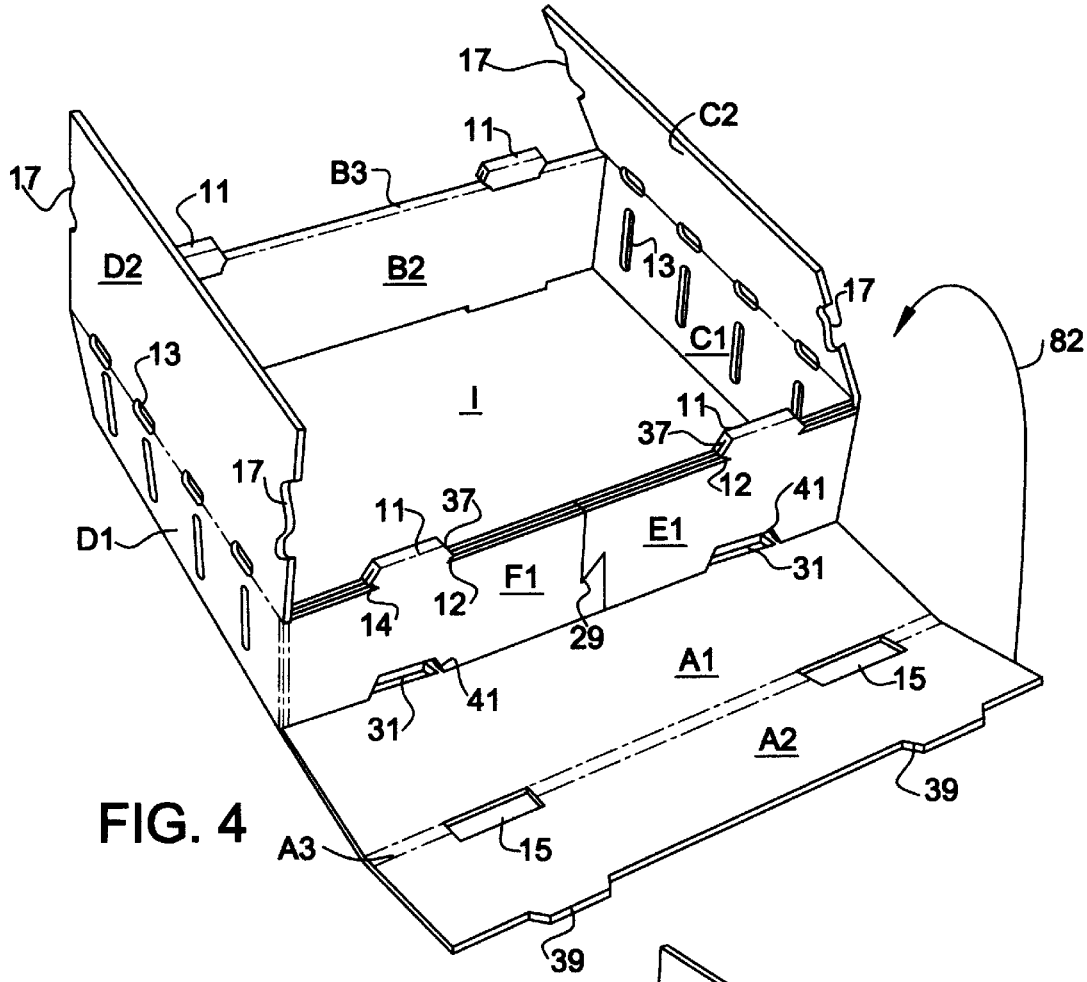
FIG. 4 is a perspective view of the blank in FIG. 1 in a third intermediate state of assembly showing the segment pairs of FIG. 3 overlapped in an accordion arrangement to form a dual-lock configuration.

The interlocking minor panels E1 and F1 and the interlocking extension panels E2 and F2 are folded inwards toward each other, as indicated by arrows 80 other until the interlocking contours 29 and 30 of these panels are in proximity to one another. This is accomplished by pivoting the interlocking minor panels E1 and F1 with respect to the lateral sidewalls 5 on foldline 67. The complementary ends of opposing interlocking minor panels E1 and F1 are mated to each other and the complimentary ends of interlocking extension panels E2 and F2 are also mated to each other. This holds the mated pair of the interlocking minor panels E1 and F1 together, holds its respective pair of interlocking extension panels E2 and F2 together, and places all of these panels E1, E2, F1, F2, G1, G2, H1, and H2 in a common plane as shown in FIG. 3. On the other side of the container 1, in a similar manner, the complementary ends of the other opposing interlocking minor panels G1 and H1 are pivoted inward and mated to each other and the complimentary ends of interlocking extension panels G2 and H2 are also mated to each other.

The mated interlocking extension panels E2 and F2 are then folded inwardly and downwardly along foldlines 69 until they are placed in a vertical position. In this position, the interlocking extension panels E2 and F2 are back-to-back and substantially horizontally superimposed with mated interlocking minor panels E1 and F1. Similar steps are performed for mated interlocking extension panels G2 and H2 on the other side of the container 1.

As is evident from FIG. 3, prior to being folded inwardly and downwardly, the interfacing end contours 30 of mated interlocking extension panels E2 and F2 are in the same orientation as the interfacing end contours 29 of the interlocking minor panels E1 and F1, but are vertically displaced. However, as shown in FIG. 8, after the mated interlocking extension panels E2 and F2 are folded inwardly and downwardly, the orientations of the interfacing end contours 30 of mated interlocking extension panels E2 and F2 are different and reversed. This is because the interfacing end contours 30 of the interlocking extension panels E2 and F2 have been rotated 180 degrees about a horizontal axis with respect to the mated interlocking minor panels E1 and F1. As described above, this provides additional resistance to floor and wall buckling.

Figure 5:
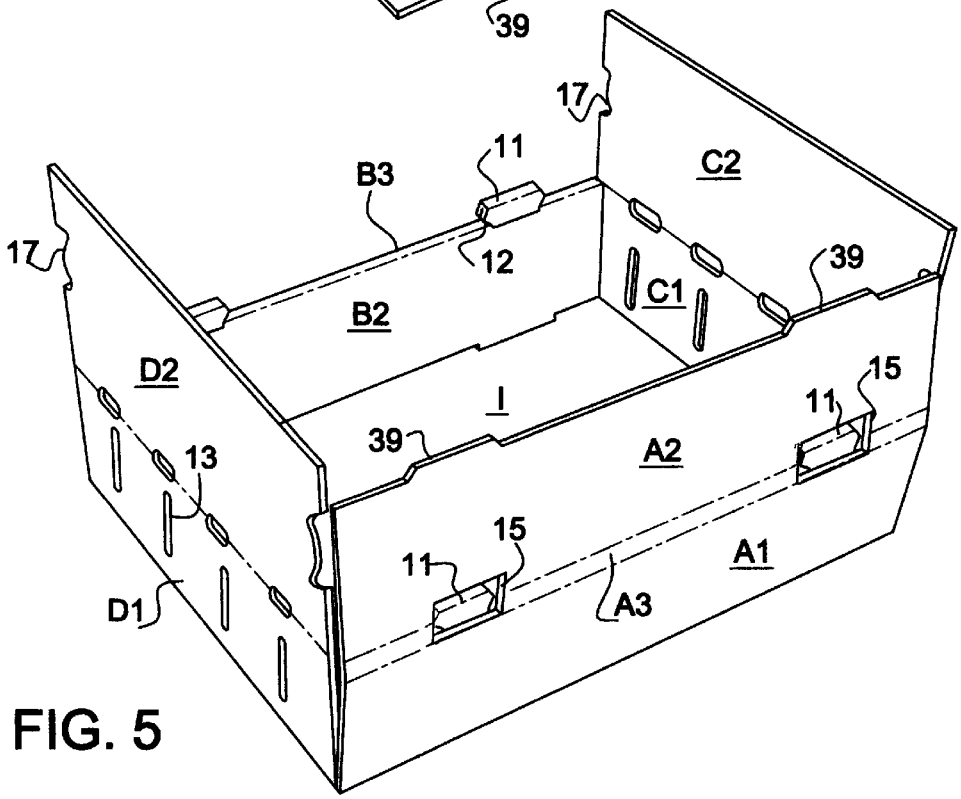
FIG. 5 is another perspective view of the blank in FIG. 1 in a fourth intermediate state of assembly showing the dual-locked segment pairs being enveloped by the inner and outer panels.

To complete the formation of the longitudinal sidewall 7, outer wall panels A1 and B1 are folded upwards until flush with the first and second interlocked minor panels E1 and F1 to form the outer panel for the longitudinal sidewall 7 is shown in FIG. 5. Inner panels A2 and B2 are then folded downwards and inwards to form the inner panel for the longitudinal sidewall 7 as shown in FIG. 6. The general direction of these folds are illustrated by arrow 82 in FIG. 4.

As inner panels A2 and B2 are folded downwards, the flange openings 15 are inserted over the angled neck 37 of the locking flanges 11. Inner panels A2 and B2 are folded further downwards, and the locking projections 12 of the flanges 11 will slightly compress by the force applied by the area around the edges of the openings 15 until the edges around the openings 15 clear the widest point of the locking projections 12. The locking projections 12 then retain the edges around the opening 15 below their angled lower surfaces and prevent an undesired inadvertent disassembly of the container 1.

The floor tongues 39 at the bottom edges of the inner panels A2 and B2 are inserted into floor grooves 31. As described, clearance for the insertion of floor tongues 39 into floor grooves 31 is provided by a clearance chamfer 41 cut into the bottom of the interlocked minor panels E1, F1, G1, and H1 and the interlocked extension panels E2, F2, G2, and H2. If desired, the spacing between the tongues 39 and grooves 31 may be such that it inherently compresses the interlocked minor and extension panels between the inner and outer wall panels A1 and A2 and B1 and B2 when the tongues 39 are inserted into grooves 31. The mating of the locking flanges 11 with corresponding flange openings 15 and floor tongues 39 with floor grooves 31 greatly enhances the structural rigidity and stacking strength of the container. The same process is completed on the other side for the other longitudinal sidewall.

FIG. 6 depicts the completed assembled container 1 with the cover panels C2 and D2 in their open position. To close the cover panels C2 and D2, they are folded downwardly with respect to lateral sidewalls 5 in the direction of arrows 83 until the cover panel notches 17 engage the locking flanges 11 and the material in the surrounding part of the cover panels C2 and D2 becomes wedged below the angled lower edges 14 of the locking wings 12. FIG. 7 shows the completed container with the cover panels C2 and D2 in their closed position. The cover panels C2 and D2 may be returned to their open position by lifting their free end so that the area around the notches 17 disengages from their respective locking flanges 11.

It should be noted that the order of the assembly steps need not be performed exactly as described above. For example, one longitudinal sidewall 7 may be assembled prior to the other, such as is shown in some of the figures.

The container has several features that improve its strength and resistance to collapse and buckling. For example, the multiple-layer design of the longitudinal sidewalls 7 resists stacking and storage loads, serves to reinforce the floor 3, and provides rigidity due to its multi-layered construction and firm interlocking of each layer to the whole. Thus, when assembled, each longitudinal sidewall 7 has four layers starting on the outside with outer wall panel A1 or B1. Moving inwards, a second layer includes the pair of interlocked minor panels E1 and F1 or G1 and H1 in a locked coplanar arrangement flush with outer wall panel A1 or B1. The next layer includes the pair of interlocked extension panels E2 and F2 or G2 and H2 in a locked coplanar arrangement, which is flush to the interlocked minor panels E1 and F1 or G1 and H1. The fourth and innermost layer includes the inner wall panel A2 or B2 which is flush to the interlocked minor panels E1 and F1 or G1 and H1. These four layers provide additional rigidity by being interconnected, or secured, to each other and the rest of container 1. Further, all of the interlocked wall panels are secured to their respective outer wall panels A1 or B1 and its respective inner panels A2 or B2 by way of the set of four locking flanges 11.

Further, if desired, additional layers of interlocking wall panels may be added. In such an arrangement, each additional layer could be folded back onto the previous adjacent layer to continue to the overlapping, back-to-back arrangement. Also, if desired, the interlocking extension panels E2, F2, G2, and H2 could be omitted and the container 1 would then rely on the locking between interlocking minor panels E1, F1, G1, and H1. It is also recognized that the width of the spacer segments A3 and B3 between inner wall panels A2 and B2 and the outer wall panels A1 and B1 would preferably be changed to correspond to the thickness of the number of overlapping pairs of the interlocked panels.

The multiple layers of the second pair of sidewalls 7 also serve to reinforce the first pair of opposing sidewalls 5 because all of the sidewalls are interconnected. Although the first pair of opposing sidewalls 5 are only a single Thickness, they are reinforced at the corners by being connected to the second pair of opposing sidewalls 7. The first and second interlocked wall panels 47 and 49 are connected along foldlines to the first pair of sidewalls 5. When second pair of opposing sidewalls 7 are erected the first and second interlocked wall panels are lockingly engaged and trapped firmly between inner panel 21 and the outer panel 23.

The container 1 is also advantageous in that it provides exceptional strength with interlocked walls without the need to apply glue, other adhesives, staples, or other fastening devices. However, if desired, glue or other adhesive may be added in the longitudinal sidewalls 7 between any number or combination of the outer wall panels A1 and B1, the inner wall panels A2 and B2, the interlocking minor panels E1, F1, G1, and H1 and the interlocking panel extensions E2, F2, G2, and H2 for additional holding strength.

The blank 25 is preferably made from a corrugated fiberboard, but it may be made from any feasible cardboard, fiberboard, or related material. Further, if the blank 25 is made from a corrugated material, it is preferred, but not required, that the corrugations run longitudinally. Further, the foldlines can be created in any feasible manner such as scoring, creasing, etc.

Preferably, the blank 25 will be cut and scored before shipping and then shipped in large stacks to be assembled on-site where needed. On-site assembly may be preformed by machine or by hand and preferably occurs before loading. Once the container 1 is fully constructed, but with the pair of opposing cover panels 9 in the open position, a worker or machine may fill the container 1 with produce or other goods. The cover panels 9 are then closed as described above to secure the produces within the container 1. The filled container 1 may then be stacked, due to its excellent rigidity, and loaded onto a truck, train or other mode of transportation.

It is noted that a plurality of ventilation holes 13 can be provided in strategic locations, such as in the cover panels C2 and in the lateral sidewall panels C1. These ventilation holes 13 provide a pathway for air to circulate and keep the contents of the container 1 fresh. While a preferred number, shape, size, position and orientation of ventilation holes 13 are shown in the figures, it is recognized that other arrangements can be used.

The container 1 may be constructed successfully of a range of materials such as plastics or fiberboard that can be cut and folded. Fiberboard has the advantage of low-cost and easy manipulation, although a problem is presented in the presence of moisture. Prolonged exposure to undue amounts of moisture is a concern because it may weaken the fiberboard material. In this case a wax or other sealant can be applied to the fiberboard to repel moisture. The multiple layers of the walls of container 1 are fairly resistant to moisture, however, and this should present little problem for most goods.

The present invention has been described in terms of preferred and exemplary embodiments thereof. Numerous other embodiments, modifications and variations within the scope and spirit of the appended claims will occur to persons of ordinary skill in the art from a review of this disclosure.

What is claimed is:

1. A container comprising:

a floor;

a first pair of opposing sidewalls extending upward from said floor; and a second pair of opposing sidewalls extending upward from said floor, each sidewall of the second pair of opposing sidewalls including an inner panel, an outer panel, and first and second interlocked wall panels, said outer panel forming an outer surface of its respective sidewall, said inner panel coupled to said outer panel and forming an inner surface of its respective sidewall, said first and second interlocked wall panels lockingly engaged with each other in a coplanar arrangement between the inner and outer panel of its respective sidewall;

wherein each sidewall of said second pair of opposing sidewalls further includes a third and fourth interlocked wall panels lockingly engaged with each other in a coplanar arrangement, said third and fourth interlocked wall panels disposed between the inner and outer panel of their respective sidewall and in back-to-back flush contact with the first and second interlocked wall panels.

2. The container of claim 1, wherein each sidewall of said second pair of sidewalls includes at least one flange opening, and said first, second, third and fourth interlocked panels include at least one locking flange extending through a corresponding flange opening.

3. The container of claim 2, further comprising a pair of opposing cover panels, each connected to one of the first pair of opposing sidewalls, said cover panels including notches lockingly engagable with said locking flanges.

4. The container of claim 1, wherein said inner panels include a plurality of locking tongues, and said floor includes a plurality of locking grooves, each said locking tongue extending into a corresponding locking groove in said floor.

5. A container comprising:

a floor;

a first pair of opposing sidewalls extending upward from said floor; and a second pair of opposing sidewalls extending upward from said floor, each sidewall of the second pair of opposing sidewalls including an inner panel, an outer panel, first and second interlocked wall panels, and third and fourth interlocked wall panels, said outer panel forming an outer surface of its respective sidewall, said inner panel coupled to said outer panel and forming an inner surface of the second sidewall, said first and second interlocked wall panels lockingly engaged with each other, said third and fourth interlocked wall panels lockingly engaged with each other, said first and second interlocked wall panels and the third and fourth interlocked wall panels disposed between their respective inner and outer panels, and said first and second interlocked wall panels disposed in back-to-back flush contact with the third and fourth interlocked wall panels.

6. The container of claim 5, wherein said first and second interlocking wall panels have inter-engaging end contours, and said third and fourth interlocking wall panels have inter-engaging end contours.

7. The container of claim 6, wherein the contours of the first and third interlocking wall panels have the same shape as each other but are in a different orientation.

8. The container of claim 5, wherein each sidewall of said second pair of sidewalls includes at least one flange opening, and said first, second, third and fourth interlocked panels include at least one locking flange extending through a corresponding flange opening.

9. The container of claim 8, further comprising a pair of opposing cover panels, each connected to one of the first pair of opposing sidewalls, said cover panels including notches lockingly engagable with said locking flanges.

10. The container of claim 8, wherein said inner panels include a plurality of locking tongues, and said floor includes a plurality of locking grooves, each said locking tongue extending into a corresponding locking groove in said floor.

11. The container of claim 8, wherein the first and second interlocked wall panels have Z-shaped contours at their interlocked ends.

12. A method of constructing a container comprising the steps of:

providing a blank having a floor panel, first and second opposing sidewall panels, third and fourth opposing sidewall panels, and first, second, third, fourth, fifth, sixth, seventh, and eighth wall panels;

folding both the first and second opposing sidewall panels upwardly with respect to the floor panel;

folding said first and second wall panels inwardly with respect to the first sidewall;

folding said third and fourth wall panels inwardly with respect to the second sidewall;

locking together the first and third wall panels in a coplanar arrangement;

locking together the second and fourth wall panels in a coplanar arrangement;

locking together the fifth and seventh wall panels in a coplanar arrangement; and locking together the sixth and eighth wall panels in a coplanar arrangement.

13. The method of claim 12, further comprising the step of folding the third and fourth opposing sidewall panels upwardly with respect to the floor panel to form outer wall surfaces.

14. The method of claim 13, further comprising folding the third opposing sidewall panel downwards and inwards to form an inner wall surface, and folding the fourth opposing sidewall panel downwards and inwards to form another inner wall surface.

15. The method of claim 12, further comprising folding downwards the fifth and seventh wall panels to place them in a back-to-back flush relationship with the first and third wall panels, and folding downwards the sixth and eighth wall panels to place them in a back-to-back flush relationship with the second and fourth wall panels.

16. A method of constructing a container comprising the steps of:

providing a blank having a floor panel, first and second opposing sidewall panels, third and fourth opposing sidewall panels, and first, second, third, fourth, fifth, sixth, seventh, and eighth wall panels;

folding both the first and second opposing sidewall panels upwardly with respect to the floor panel;

folding said first, second, third and fourth wall panels inwardly with respect to the first sidewall;

folding said fifth, sixth, seventh, and eighth wall panels inwardly with respect to the second sidewall;

directly coupling together the first and third wall panels and the fifth and seventh wall panels; and directly coupling together the second and fourth wall panels and the sixth and eighth wall panels.

17. The method of claim 16, further comprising folding downwards the fifth and seventh wall panels to place them in a back-to-back flush relationship with the first and third wall panels, and folding downwards the sixth and eighth wall panels to place them in a back-to-back flush relationship with the second and fourth wall panels.

18. The method of claim 17, further comprising the step of folding the third and fourth opposing sidewall panels upwardly with respect to the floor panel to form outer wall surfaces.

19. The method of claim 18, further comprising folding the third opposing sidewall panel downwards and inwards to form an inner wall surface, and folding the fourth opposing sidewall panel downwards and inwards to form another inner wall surface.

20. The method of claim 19, further comprising inserting tongues on the third and fourth opposing sidewall panels into grooves in the floor panel.

21. A blank for forming a container comprising:

a floor panel;

first and second opposing sidewall panels extending from the floor panel;

third and fourth opposing sidewall panels extending from the floor panel;

first and second wall panels extending from the first sidewall panel, each of the first and second wall panels having a proximal end adjacent to the first sidewall and a distal end, the distal end including a planar locking contour;

third and fourth wall panels extending from the second sidewall panel, each of the third and fourth wall panels having a proximal end adjacent to the second sidewall panel and a distal end spaced from the second sidewall panel, the distal end including a planar locking contour, wherein the planar locking contour of the first wall panel is complementary in shape to the locking contour of the third wall panel permitting locking engagement therebetween, and the planar locking contour of the second wall panel is complementary in shape to the locking contour of the fourth wall panel permitting locking engagement therebetween; and a first cover flap and a second cover flap, said first cover flap coupled to the first sidewall panel and said second cover flap coupled to the second sidewall panel;

wherein said first, second, third and fourth wall panels each includes a locking flange and the third and fourth opposing sidewall panels each includes a pair of flange openings therein for receiving the locking flanges.

22. The blank of claim 21, wherein said planar locking contours of said first, second, third, and fourth wall panels are Z-shaped.

23. A blank for forming a container comprising:

a floor panel;

first and second opposing sidewall panels extending from the floor panel;

third and fourth opposing sidewall panels extending from the floor panel;

first and second wall panels extending from the first sidewall panel, each of the first and second wall panels having a proximal end adjacent to the first sidewall and a distal end, the distal end including a planar locking contour;

third and fourth wall panels extending from the second sidewall panel, each of the third and fourth wall panels having a proximal end adjacent to the second sidewall panel and a distal end spaced from the second sidewall panel, the distal end including a planar locking contour, wherein the planar locking contour of the first wall panel is complementary in shape to the locking contour of the third wall panel permitting locking engagement therebetween, and the planar locking contour of the second wall panel is complementary in shape to the locking contour of the fourth wall panel permitting locking engagement therebetween; and a first cover flap and a second cover flap, said first cover flap coupled to the first sidewall panel and said second cover flap coupled to the second sidewall panel;

wherein said third and fourth opposing sidewall panels each includes a locking tongue and the floor includes grooves therein for receiving a locking tongue.

24. The blank of claim 23, wherein said planar locking contours of said first, second, third, and fourth wall panels are Z-shaped.

25. A blank for forming a container comprising:

a floor panel;

first and second opposing sidewall panels extending from the floor panel;

third and fourth opposing sidewall panels extending from the floor panel;

first and second wall panels extending from the first sidewall panel, each of the first and second wall panels having a proximal end adjacent to the first sidewall and a distal end, the distal end including a planar locking contour;

third and fourth wall panels extending from the second sidewall panel, each of the third and fourth wall panels having a proximal end adjacent to the second sidewall panel and a distal end spaced from the second sidewall panel, the distal end including a planar locking contour, wherein the planar locking contour of the first wall panel is complementary in shape to the locking contour of the third wall panel permitting locking engagement therebetween, and the planar locking contour of the second wall panel is complementary in shape to the locking contour of the fourth wall panel permitting locking engagement therebetween;

a first cover flap and a second cover flap, said first cover flap coupled to the first sidewall panel and said second cover flap coupled to the second sidewall panel; and fifth, sixth, seventh, and eighth wall panels, said fifth wall panel coupled to said first wall panel, said sixth wall panel coupled to said second wall panel, said seventh wall panel coupled to said third wall panel, and said eighth wall panel coupled to said fourth wall panel, and each of said fifth, sixth, seventh and eighth wall panels having an end with a planar locking contour, wherein the planar locking contour of the fifth wall panel is complementary in shape to the locking contour of the seventh wall panel permitting locking engagement therebetween, and the planar locking contour of the sixth wall panel is complementary in shape to the locking contour of the eighth wall panel permitting locking engagement therebetween.

26. The blank of claim 25, wherein said planar locking contours of said fifth, sixth, seventh, and eighth wall panels are Z-shaped.

27. The blank of claim 26, wherein said planar locking contours said first, second, third, and fourth wall panels are Z-shaped.

* * * * *